United States Patent [19]

Seemann et al.

[11] Patent Number: 4,874,310

[45] Date of Patent: Oct. 17, 1989

[54] LOW NOX BURNER

[75] Inventors: Howard Seemann, Seaford, N.Y.; Chad F. Gottschlich, Philadelphia, Pa.

[73] Assignee: Selas Corporation of America, Dresher, Pa.

[21] Appl. No.: 160,265

[22] Filed: Feb. 25, 1988

[51] Int. Cl.[4] ..... F23C 7/00

[52] U.S. Cl. ..... 431/8; 431/12; 431/188

[58] Field of Search ..... 431/187, 284, 354, 355, 431/188, 159, 8, 171, 187, 12; 239/428; 126/116

[56] References Cited

U.S. PATENT DOCUMENTS

| | | | |
|---|---|---|---|
| 324,005 | 8/1885 | Burrell | 239/428 |
| 399,864 | 3/1889 | Fisk | 431/187 |
| 784,126 | 3/1905 | Schurs | 239/428 |
| 837,571 | 12/1906 | Jackson | 239/419.5 |
| 1,029,031 | 6/1912 | Schilke | 239/419.5 |
| 1,299,843 | 4/1919 | Long | 239/138 |
| 1,515,172 | 11/1924 | Ronstrom | 239/419.5 |
| 1,527,920 | 2/1925 | Roberts | 239/417.5 |
| 1,612,256 | 12/1926 | Marron | 242/65 |
| 1,695,334 | 12/1928 | Johnston | 239/419.5 |
| 1,711,982 | 5/1929 | Argo et al. | 431/354 |
| 2,111,827 | 3/1938 | MacIWaters | 158/9 |
| 2,117,270 | 5/1938 | Bloom | 431/354 |
| 2,466,100 | 4/1949 | Harrah | 158/76 |
| 3,133,731 | 5/1964 | Reed | 431/187 |
| 3,663,153 | 5/1972 | Bagge et al. | 431/187 |
| 3,684,189 | 8/1972 | Reed et al. | 239/425.5 |
| 3,729,285 | 4/1973 | Schwedersky | 431/8 |
| 3,737,281 | 6/1973 | Guth | 431/352 |
| 4,004,875 | 1/1977 | Zink et al. | 431/187 |
| 4,152,108 | 5/1979 | Reed et al. | 431/188 |
| 4,402,666 | 9/1983 | Glomm et al. | 431/187 |
| 4,579,280 | 4/1986 | Von Ruhling | 239/8 |

FOREIGN PATENT DOCUMENTS

| | | | |
|---|---|---|---|
| 732259 | 6/1932 | France | 431/354 |

OTHER PUBLICATIONS

Masai–Patent Abstracts of Japan, 60–191103, (9/28/85).

*Primary Examiner*—Ira S. Lazarus
*Assistant Examiner*—Christopher Hayes
*Attorney, Agent, or Firm*—Austin R. Miller

[57] ABSTRACT

A controlled primary air inspirating gas burner is provided with a fuel inspirating jet and an induced primary air passageway, with a means forming a separate control primary air passageway, together with means for controlling the introduction of control primary air. The content of nitrogen oxides in the flue gas is substantially reduced by introduction of regulated amounts of control primary air into the burner.

19 Claims, 3 Drawing Sheets

LOW NOX BURNER

This invention relates to a controlled primary air inspirating gas burner, and particularly relates to a burner and furnace and method of operating the burner in a manner to reduce substantially the content of nitrogen oxides in the flue gas. Hereinafter nitrogen oxides, which are primarily nitric oxide and nitrogen dioxide, are collectively referred to as NOx.

Major environmental and other problems have been encountered in the production of flue gases containing high contents of NOx. The NOx tends to react under atmospheric conditions to form environmentally unacceptable conditions, including the widely known phenomenon known as acid rain. In the United States and elsewhere environmental legislations and restrictions have been enacted, and more are expected to be enacted in the future, severely limiting the content of NOx in flue gases.

It is an object of this invention to provide a controlled primary air inspirating gas burner which, when utilized in conjunction with a furnace, has the capability of controllably limiting the content of NOx in the flue gas emanating from the furnace.

A further object of this invention is to provide such a controlled primary air inspirating gas burner which is operable independently of draft, leakage and other conditions inherent in the furnace, and which can be independently adjusted to provide a predetermined NOx level in the flue gas emanating from the furnace.

Another object of this invention is to provide a controlled primary air inspirating gas burner having improved backfire resistance, as opposed to draft-controlled inspirating gas burners presently used, even when using highly flammable gases such as hydrogen or the like. Still another object of the invention is to provide such a burner which is capable of operating with even low pressure waste gases as the fuel source.

Still another object of this invention is to provide a burner having the capability of substantially reducing NOx in the combustion product, while eliminating the possibility of creating an explosive atmosphere within the burner.

Other objects and advantages of this invention, including the ease with which the burners of this invention may be utilized in retrofitting existing furnace structures, will become apparent hereinafter and in the drawings.

Figure 1:
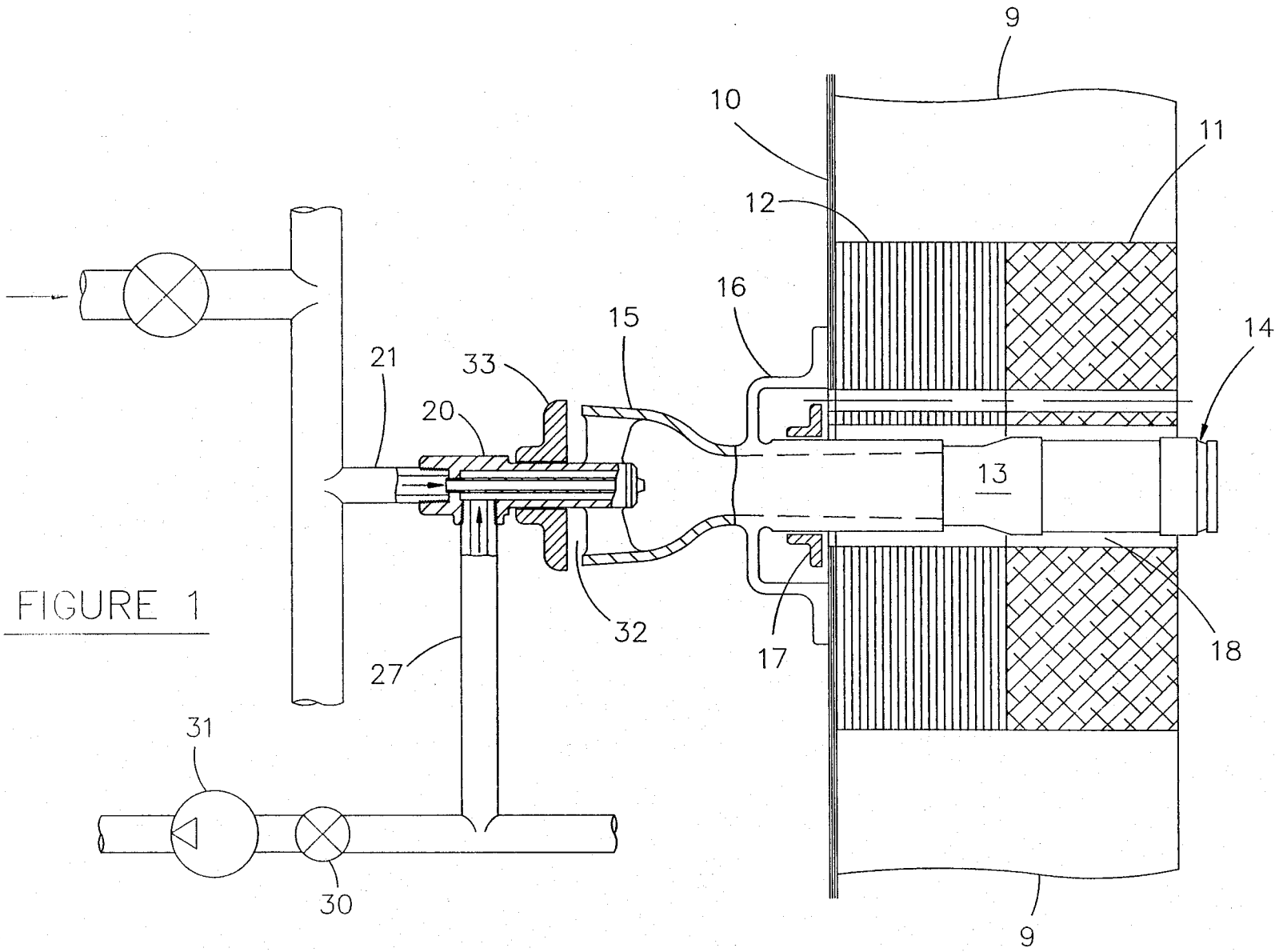
FIG. 1 is a fragmentary sectional view of a portion of a furnace, illustrating the furnace wall and the manner in which the burners of this invention may be installed.

It will be appreciated that the following description is intended to refer to the specific embodiment of the invention selected for illustration in the drawings, and is not intended to define or to limit the invention, other than in the appended claims.

Turning now to the specific form of the invention illustrated in the drawings, and referring particularly to FIG. 1, the number 10 indicates a furnace casing to which is attached a burner block 11, with intervening block insulation 12. The number 9 designates the furnace wall. The number 13 designates a venturi tip assembly inserted through an opening in the block, provided with a burner tip 14 which is arranged to introduce combustible products into the furnace. Although the burner tip 14 has been shown as a flat flame type of tip, which is preferred in many aspects of the practice of this invention, various other forms of burner tips may be utilized. Further, while the burner tip may be provided in direct conjunction with the interior surface of the furnace wall, wide varieties of refractory cups, etc., or clusters of burners may be arranged inside a block to increase heating capacity.

The number 15 designates the venturi of the burner, and the number 16 designates a mounting bracket connecting the venturi tip assembly 13 to the furnace casing 10. The mounting bracket 16 provides space for inflow of secondary air between the burner and the furnace wall, and the number 17 designates a secondary air shutter which, in accordance with this invention, is normally kept in a closed condition, for important reasons which will appear in further detail hereinafter. The number 18 designates the secondary air passage between the venturi tip assembly 13 and the burner block 11 and block insulation 12, which passage is also normally kept closed, in view of the closure of the secondary air shutter 17.

Figure 2:
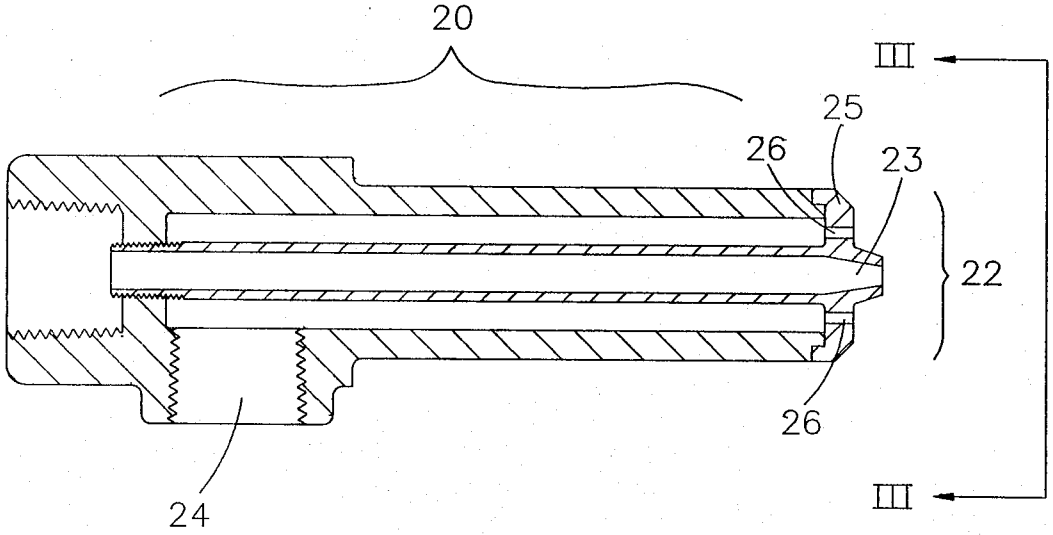
FIG. 2 is a sectional view of an orifice body comprising an element of the burner of this invention.
Figure 4:
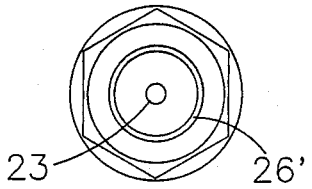
FIG. 4 is an end view similar to FIG. 3 wherein the control primary air enters through an annular port.

Referring to FIGS. 1 and 2, the number 20 designates an orifice body which is introduced upstream of the restriction of venturi 15, and which is adjustable longitudinally toward and away from the venturi jet restriction. The number 21 designates a fuel gas supply tube which is arranged to supply gas to the jet, from a controllable manifold or the like.

The number 22 (FIG. 2) designates a jet nozzle, which is preferably centered with respect to the venturi 15. An orifice 23 is provided for the fuel jet, at the end of the nozzle.

The number 24 (FIG. 2) designates a supply passage for introducing control primary air into the orifice body 20. A cap 25 is provided having a plurality (shown in FIG. 3 as six) orifices 26 for jetting control primary air into the venturi 15. Control primary air is supplied to the orifice body 20 by a control primary air supply pipe 27, (FIG. 1) and the flow and pressure of control primary air are regulated by a control valve 30. The number 31 designates a compressor, which is here shown as the source of the control primary air.

Induced primary air is drawn into the venturi 15 through the induced primary air passageway 32, controlled by an induced primary air shutter 33 which is movable longitudinally toward and away from the venturi 15 in a manner to control the area of the opening for the induced primary air.

Figure 3:
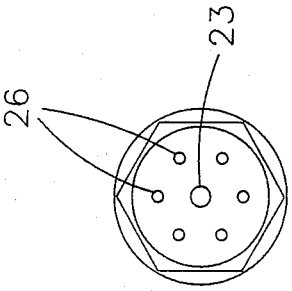
FIG. 3 is an end view taken as indicated by the lines and arrows III—III which appear in FIG. 2.

Referring now to FIG. 3, it will be apparent that the fuel jet orifice 23 is substantially centered with respect to the control primary air orifices 26, which are provided at equally spaced distances around the fuel jet orifice 23.

The method of operation of the burner in accordance with this invention will now become apparent. The burner is ignited in the usual manner with the use of the gas supply to the central orifice, and by utilizing the inspirating characteristics of the fuel jet, induced primary air is taken in through the passageway 32, and the burner is operated in a manner to introduce combustible products through the burner tip 14. When it is desired to reduce the NOx content of the stack gases in the furnace, the control primary air compressor 31 is operated and, through the controlling influence of the valve 30, is introduced through the control primary air jet orifices 26 in the jet nozzle 22. The introduction of control primary air under pressure coacts with the introduction of gas supply to the central orifice to induce further flow of induced primary air through the passageway 32. The presence of the control primary air has surprisingly been found to provide a significant reduction in the NOx content of the combustion products.

The introduction of control primary air functions like a pump, and by pumping additional inducated primary air without adding more gas, an optimum combustion condition is produced, coupled with an important reduction in the content of NOx in the combustion product. This result would not be obtainable by simply increasing gas flow.

A further advantage of the invention is that the burner may be operated independently of the furnace conditions, such as stack draft, furnace leakage, etc. The content of NOx can be rather accurately controlled by accurately controlling the introduction of compressed control primary air.

The introduction of control primary air also greatly improves backfire resistance, even when using gases which are prone to backfire, such as hydrogen or the like. Another advantage of the invention is that it can be used even with low pressure waste gases as the fuel source.

The provision of one or more separate passageways for the control primary air eliminates the possibility of creating explosive mixtures in the fuel conduits, and greatly enhances the flexibility of operation of the apparatus and of the furnace. It is an important advantage of this invention that the method may be practiced in the absence of any secondary air. In accordance with this method, the NOx content of the flue gas may be reduced in a furnace fired by one or many burners, by performing the steps of separately introducing into the burners a separate stream of control primary air for admixture with the gaseous fuel, and controlling the rate of introduction of the separate stream of control primary air in order to create the desired or requisite reduction of the content of NOx in the combustion gases from the furnace. This enables the operator of the furnace to obtain accurate NOx control at the burner and independently of the operation of the furnace.

It is an important advantage that the control primary air is introduced as an inspirating jet in a manner to induce flow of induced primary air. It is a further advantage of the invention that both the inspirating jet of gas and the inspirating jet of control primary air are substantially concentrically related with respect to the venturi.

Figure 6:
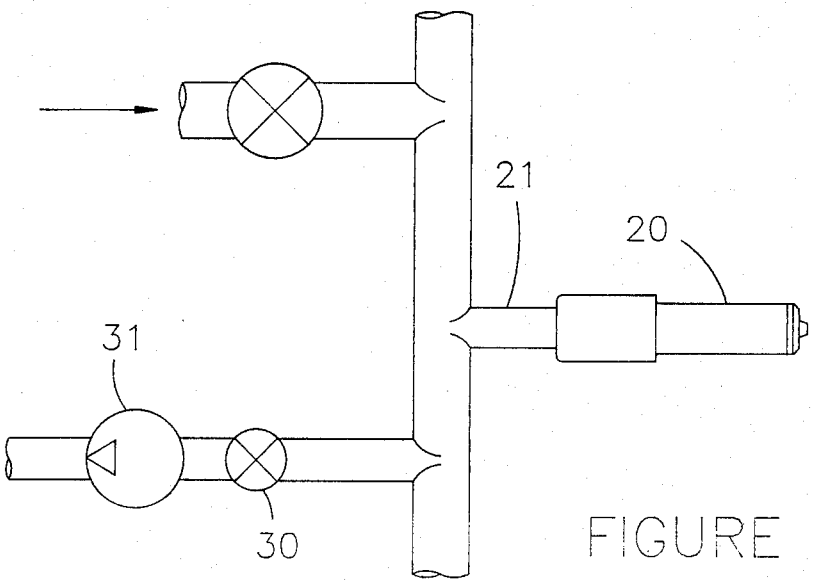
FIG. 6 is a schematic view showing an alternate portion of FIG. 1 wherein the fuel gas and the control primary air are introduced as one inspirating jet.

In the alternative they may be introduced together as an inspirating jet, as indicated in FIG. 6.

It will be appreciated that this invention may be practiced with a wide variety of gaseous fuels, including natural gas, CO, hydrogen, propane, hydrogen-rich fuels some refinery waste fuels and other gaseous or vaporized fuels such as vaporized naptha, for example.

Figure 5:
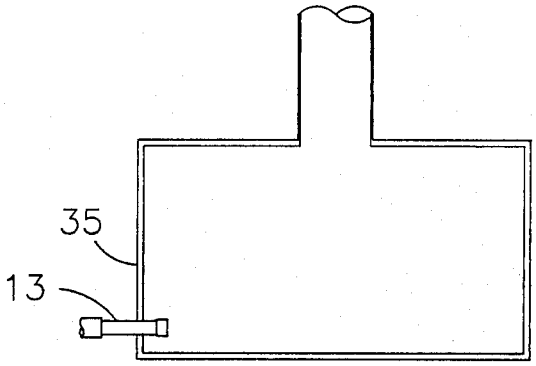
FIG. 5 is a fragmentary view of a furnace wall which is substantially sealed to the burner 13.

Although the gas pressure to be utilized at the jet is not critical, it may normally be about 15 to 25 psig, and in other cases 1 to 50 psig or even higher in the case of some of the leaner gases, such as hydrogen, for example. Further, the invention may be used with a wide variety of burner constructions, and with a wide variety of furnace installations, including flat frame burners operating along the furnace wall, and burners positioned in ceramic cups or other structures. Wide varieties of control primary air pressures may be utilized at the burner as well. Further, wide varieties of ratios may be utilized with respect to the percentage of control primary air to the total stoichiometric air required to burn the gaseous fuel. It is important, however, that this invention may be operated independently of any secondary air, as in FIG. 5 with the burner 13 extending through the furnace wall 35 in a substantially sealed manner to preclude the passage of secondary air, since this gives complete control of the furnace by controlling the burner independently of furnace operating parameters.

It has been discovered that the control primary air has a major effect on combustion conditions. At a constant firing rate, and with enough air present to be 100% stoichiometric, the addition of control primary air significantly reduces the percentage of NOx in the combustion products.

Various tests have been conducted, utilizing a furnace operated under normal conditions, utilizing high temperature ethylene and experiencing 130–140 mg of NOx (expressed as NO2) per normal cubic meter of exhaust gas (dry) containing 3% oxygen. It has been found that the content of NOx in the combustion products has been greatly reduced because of the introduction of control primary air in accordance with this invention.

The amount of control primary air to be added varies in accordance with many factors, including the capacity of the particular venturi utilized in the burner.

In utilizing the terms "primary air" and "secondary air" in this specification it will be understood that the expression "primary air" is intended to be directed to air premixed with the gaseous fuel in the burner, whereas the expression "secondary air" is intended to be applied to air mixed beyond the burner nozzle and not conducted through the body of the burner. As shown in FIG. 1, any secondary air (though there is normally none in the practice of this invention) would be introduced through the passage 18, outside the body of the burner, for admixture with the combustion products outside the nozzle 14. The advantages of this invention can still be realized even if the operator of the furnace should decide to use secondary air in addition to control primary air and induced primary air. Control of flue gas NOx can still be obtained, independently of stack draft, furnace temperature and other furnace conditions, by regulating the amount of control primary air introduced into the burner in accordance with this invention.

Although this invention has been described with reference to specific embodiments it will be appreciated that many variations may be made without departing from the spirit and scope of the invention. For example, various jet nozzle configurations may be resorted to, utilizing various numbers of passageways for the gas supply and the supply of control primary air, and with either gas or air passages surrounding the other. For example, gas may be introduced into supply passage 24 and control primary air into supply tube 21, in which case the control primary air is surrounded by gas jets which in turn are surrounded by induced primary air in the venturi 15.

Although a plurality of primary air ports is preferred, an annular port concentric with and surrounding gas port 23 may be utilized.

The size and shape of the venturi 15 may be varied toward a more cylindrical shape and even a straight pipe may be substituted for the venturi in some installations.

Further, burners intended for new installation, or even in some cases for retro-fitting, may be provided without the utilization of any secondary air shutter 17 or secondary air passage 18, since these are not necessarily functional or utilized in the practice of the invention. Other variations may be made, as will be apparent to those skilled in the art, with respect to burner construction, burner tips, etc.

We claim:

1. A controlled primary air inspirating gas burner comprising:

a burner body having a burner tip adapted to be installed in a furnace or the like for combustion of gaseous fuel therein, a fuel inspirating jet positioned in said body upstream of said tip and having an open gaseous fuel orifice for introduction of gaseous fuel into said burner body, means for supplying gaseous fuel under pressure to said inspirating jet, means forming an induced primary air passageway upstream of said burner tip for flow of induced primary air into said body for mixing with said gaseous fuel prior to exiting said burner tip, means forming a separate control primary air passageway located upstream of said induced primary air passageway and extending into said burner body adjacent said inspirating jet for separately introducing control primary air into said body, pressure means connected to introduce said control primary air into said fuel inspirating jet, and separate control means for controlling the rate of introduction of said control primary air into said burner body, whereby the NOx content of the resulting flue gas can be reduced in the absence of secondary air.

2. The burner defined in claim 1 wherein the control primary air passageway is located concentrically to said gaseous fuel orifice.

3. The burner defined in claim 1 wherein the control primary air passageway is an inspirating jet constructed and arranged to induce said flow of induced primary air.

4. The burner defined in claim 3 wherein said means forming a separate control primary air passageway comprises a plurality of control primary air passageways provided in a configuration surrounding said fuel inspiration jet.

5. The burner defined in claim 1 wherein the control primary air passageway is an inspiration jet arranged to induce flow of induced primary air and wherein there is no provision for introduction of any secondary air.

6. The burner defined in claim 1 with means provided for adding secondary air to the furnace.

7. The burner defined in claim 1 wherein the fuel inspirating jet is substantially concentric in the burner body.

8. The burner defined in claim 1 wherein the control primary air passageway comprises an inspirating jet substantially concentric in the burner body.

9. The burner defined in claim 8 wherein the fuel inspirating jet and the control air inspirating jet are substantially concentric in the burner body.

10. The burner defined in claim 9 wherein a plurality of control air inspirating jets are arranged around the fuel inspirating jet.

11. The burner defined in claim 8 wherein an annular port concentric with said fuel inspirating jet comprises the primary control air inspirating jet.

12. The burner defined in claim 9 wherein six control air inspirating jets are arranged in substantially equally spaced positions around said fuel inspirating jet.

13. A furnace having a wall and a burner of claim 1 extending through said wall in a substantially sealed manner to preclude the passage of secondary air.

14. A furnace having a wall and a burner of claim 1, with a secondary air passage extending between the wall and the burner to admit a minimal flow of secondary air.

15. The furnace defined in claim 13 wherein the burner has a flat-flame tip configured to project a combustible mixture of fuel gas, induced primary air and control primary air for combustion directly along said wall.

16. In a method of reducing the NOx content of flue gas in a furnace fired by a burner extending through a furnace wall, said burner introducing gaseous fuel at an upstream location and induced primary air at a downstream location for combustion within said furnace, the steps which comprise:

(a) separately introducing into said burner under pressure a separate stream of control primary air upstream of said downstream location for admixture with said gaseous fuel, and (b) controlling the rate of introduction of said separate stream of control primary air.

17. The method defined by claim 16, wherein the control primary air is introduced as an inspirating jet in a manner to induce said flow of induced primary air.

18. The method defined in claim 16 wherein the fuel gas and control primary air are together introduced as an inspirating jet in a manner to induce flow of induced primary air.

19. The method defined in claim 16 wherein the burner is operated independently of furnace stack draft and the content of NOx is controlled by controlling said introduction of compressed control primary air.

* * * * *